US011937679B2

(12) United States Patent
Bourquin

(10) Patent No.: US 11,937,679 B2
(45) Date of Patent: Mar. 26, 2024

(54) HAIR STYLING DEVICE

(71) Applicant: KONINKLIJKE PHILIPS N.V., Eindhoven (NL)

(72) Inventor: Yannyk Parulian Julian Bourquin, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 538 days.

(21) Appl. No.: 17/048,647

(22) PCT Filed: Apr. 23, 2019

(86) PCT No.: PCT/EP2019/060268
§ 371 (c)(1),
(2) Date: Oct. 19, 2020

(87) PCT Pub. No.: WO2019/206852
PCT Pub. Date: Oct. 31, 2019

(65) Prior Publication Data

US 2021/0235835 A1 Aug. 5, 2021

(30) Foreign Application Priority Data

Apr. 25, 2018 (EP) ..... 18169210
Jan. 15, 2019 (EP) ..... 19151968

(51) Int. Cl.
*A45D 2/00* (2006.01)
*A45D 2/36* (2006.01)

(52) U.S. Cl.
CPC ..... *A45D 2/001* (2013.01); *A45D 2/36* (2013.01); *A45D 2200/205* (2013.01)

(58) Field of Classification Search
CPC ..... A45D 2/001; A45D 2/36; A45D 2200/205
See application file for complete search history.

(56) References Cited

U.S. PATENT DOCUMENTS 7,699,058 B1 4/2010 Jay
9,116,266 B2 8/2015 Nakai
(Continued)

FOREIGN PATENT DOCUMENTS

DE WO 2013189786 * 12/2013
FR WO2010067323 * 6/2010
(Continued)

OTHER PUBLICATIONS

Altmann et al. Translation (Year: 2013).*
(Continued)

*Primary Examiner* — Rachel R Steitz
*Assistant Examiner* — Brianne E Kalach

(57) ABSTRACT

A hair styling device (S), comprising a luminescent unit (LU) for subjecting hair (H) to optical radiation. Preferably, the luminescent unit (LU) is arranged to translate a first wavelength of light (Li) from a light source (L) into a second wavelength of N escaping light (EL) escaping from the luminescent unit (LU). Preferably, light escapes from the luminescent unit (LU) where hair (H) touches the luminescent unit (LU). Preferably, the luminescent unit (LU) is provided with a scattering element. A refractive index of the luminescent unit (LU) may range from 1.3 to 1.7, preferably 1.3 to 1.42. Preferably, the luminescent unit (LU) provides for a plurality C of treatment compartments. The hair styling device preferably comprises a handle having a light source (L) for coupling light (Li) into the luminescent unit (LU), and may be provided with a plurality of exchangeable luminescent units (LU) each adapted for a respective hair styling type, which exchangeable luminescent units (LU) are insertable into the handle.

20 Claims, 2 Drawing Sheets

(56) References Cited

U.S. PATENT DOCUMENTS

| | | | | |
|---|---|---|---|---|
| 2004/0206368 | A1 | 10/2004 | Warner | |
| 2011/0284123 | A1* | 11/2011 | Bouix | G01F 11/025 222/113 |
| 2014/0276685 | A1 | 9/2014 | Gustavsson | |
| 2015/0173480 | A1 | 6/2015 | Washington | |

FOREIGN PATENT DOCUMENTS

| | | | |
|---|---|---|---|
| FR | WO 2010067323 | * | 6/2010 |
| FR | WO2017031334 | * | 2/2017 |
| JP | 2009070751 A | | 4/2009 |
| JP | 2018029815 | | 3/2018 |
| JP | 2019126452 | | 8/2019 |
| KR | 20-2015-0000091 | * | 1/2015 |
| WO | 2009/074957 | | 6/2009 |
| WO | 2013/142497 | | 9/2013 |
| WO | 2017/108639 | | 6/2017 |
| WO | 2017/153121 | | 9/2017 |
| WO | 2019/048357 | | 3/2019 |

OTHER PUBLICATIONS

Machine Translation of Lee; Available Jan. 2015.*

International Search Report and Written Opinion dated Jul. 31, 2019 For International Application No. PCT/EP2019/060268 Filed Apr. 23, 2019.

International Preliminary Report On Patentability dated Nov. 26, 2019 For International Application No. PCT/EP2019/060268 Filed Apr. 23, 2019.

Tummeltschammer, et al: "Losses in luminescent solar concentrators unveiled" , Solar Energy Materials and Solar Cells, vol. 144, Jan. 2016.

* cited by examiner

HAIR STYLING DEVICE

CROSS REFERENCE TO RELATED APPLICATIONS

This application is the U.S. National Phase application under 35 U.S.C. § 371 of International Application No. PCT/EP2019/060268 filed Apr. 23, 2019, which claims the benefit of European Patent Application Number 18169210.4 filed Apr. 25, 2018 and European Patent Application Number 19151968.5 filed Jan. 15, 2019. These applications are hereby incorporated by reference herein.

FIELD OF THE INVENTION

The invention relates to a hair styling device for photothermal hair reshaping.

BACKGROUND OF THE INVENTION

WO2017153121, incorporated herein by reference, discloses a hair styling device which comprises a pulse-driven light emitting diode (LED) or an array of LEDs configured to deliver optical energy to hair, wherein an output wavelength is in the range 400-900 nm, with good results in the range 400-650 nm, and preferably in the range 450-550 nm, a pulse width is in the range 50-300 ms, preferably between 50 and 200 ms, such as in the range 100-200 ms, or between 50 and 100 ms, a LED pulse driver circuit to drive the LED/s, a control system to control the LED pulse driver, particularly controlling pulse electrical parameters including voltage, pulse duration, and pulse duty cycle, a hair contacting interface configured to contact the hair and hold the hair in a pre-configured shape, e.g. planar, cylindrical, during pulsed light exposure provided by the LED, and an optical shield configured to block stray light during light exposure of hair.

SUMMARY OF THE INVENTION

It is, inter alia, an object of the invention to provide an improved hair styling device. The invention is defined by the independent claims. Advantageous embodiments are defined in the dependent claims.

One aspect of the invention provides a hair styling device, comprising a luminescent unit for subjecting hair to optical radiation. Preferably, the luminescent unit is arranged to translate a first wavelength of light from a light source into a second wavelength of escaping light escaping from the luminescent unit. Preferably, the luminescent unit is arranged to hamper light from escaping from the luminescent unit except where hair touches the luminescent unit, e.g. by having mirrors at ends of the luminescent unit. Preferably, the luminescent unit is provided with a scattering element. A refractive index of the luminescent unit may range from 1.3 to 1.7, preferably 1.3 to 1.42. Preferably, the luminescent unit provides for a plurality of treatment compartments. The hair styling device preferably comprises a handle having a light source for coupling light into the luminescent unit, and may be provided with a plurality of exchangeable luminescent units each adapted for a respective hair styling type, which exchangeable luminescent units (LU) are insertable into the handle.

Photothermal hair re-shaping suffer from difficulty in providing homogenous light intensity to a sufficiently large buddle of hair due to design constraints and inherent parameter from the light source. In this invention we describe a way of providing homogenous light to hairs without being limited design constraints. Embodiments of the invention are based on the use of luminescent unit to trap the light into a waveguide and homogenously spread the light intensity towards hairs with several design possibilities. A shape of the luminescent unit is preferably adapted to the kind of hair styling to be carried out by the hair styling device.

These and other aspects of the invention will be apparent from and elucidated with reference to the embodiments described hereinafter.

DESCRIPTION OF EMBODIMENTS

Figure 1:
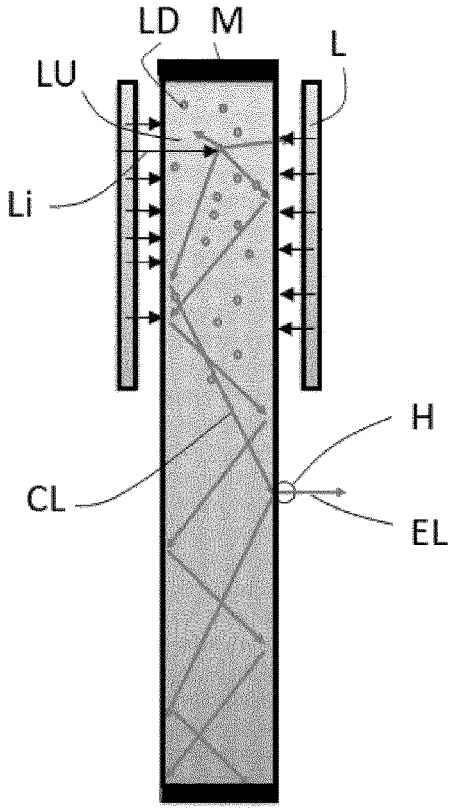
FIGS. 1-4 show embodiments of the invention.

FIG. 1 illustrates principles used in embodiments of the invention. Photo-thermal hair re-shaping suffers from difficulties in providing homogenous light intensity to a sufficiently large bundle of hair due to design constraints and inherent parameters from the light source. The embodiments provide homogenous light to hairs H without being limited by design constraints. The embodiments are based on the use of luminescent unit LU to trap the light into a waveguide, and can homogenously spread the light intensity towards hairs H with several design possibilities. The luminescent unit comprises a light-transmitting body, the light-transmitting body comprising one or more radiation input faces, and a luminescent material configured to convert at least part of light from a light source into converted light.

In FIG. 1, light sources L send light Li to a luminescent unit LU, which here takes the shape of a luminescent rod. The light sources L may be LED arrays or organic LEDs (OLEDs) or lasers. The luminescent unit has luminescent dye LD, and mirrors M at both ends of the luminescent rod. As a result of the luminescent dye LD, the incoming light Li is translated into converted light CL. Where hair H touches the luminescent unit LU, escaping light EL escapes from the luminescent unit LU.

The light sources L emit light Li towards the luminescent unit LU. The fluorescent dye LD within the luminescent unit LU converts the light into a second wavelength and emits the light in all directions. The wavelength conversion is an important aspect of some embodiments, and provides the advantage that sufficient light is trapped within the light guide. The type of wavelength to use is here a secondary aspect as potentially any wavelength could be used for hair styling. Some examples of wavelength conversion could be: from UV (<400 nm) to blue light (~450-520 nm). UV would be considered not safe in a standard configuration, but using the conversion, the light escaping from the device is in the safe range. Alternatively, blue light (~450 nm) is converted to infrared (>700 nm), in this case the light escaping from the device would be invisible to the user, while blue light LEDs can provide high power input. The refractive index of the luminescent unit would range from 1.3 to 1.7, preferably 1.3 to 1.42.

Part of this re-emitted light is trapped into the luminescent rod waveguide due to total internal reflection (TIR) and travels along the luminescent unit LU as the material is transparent for this re-emitted wavelength. Total internal reflection is a phenomenon where energy is not lost. Where hair H is in contact with the side of the luminescent unit LU, part of the converted light CL escapes into the hair H due to frustrated internal reflection.

Mirrors M are placed at both ends of the luminescent unit LU to keep the light travelling back and forth within the luminescent unit LU, while the main light escape is from contact with the hair. Thus, the potential emission of light from the surface is always homogenous as only a small part of the light can escape when the hair enters in contact with the luminescent unit LU. In other words, this addresses the issue related to inhomogeneity of light from a light source.

Figure 2:
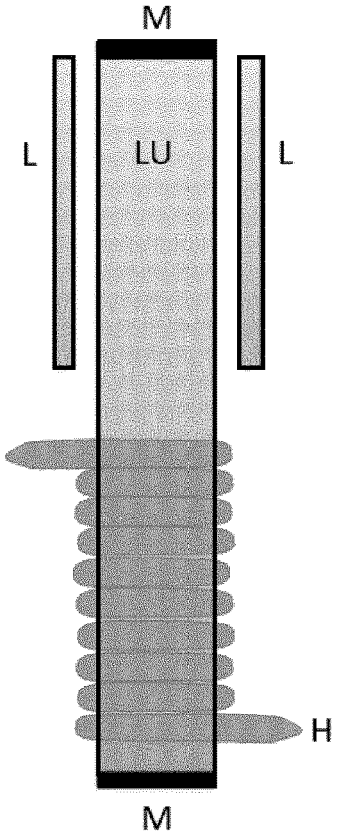

From these principles, several embodiments for hair reshaping can be derived. For example, in one embodiment as shown in FIG. 2, the luminescent unit LU is in a form of a cylinder or rod where the hair H can be wound around the rod in such a manner, that hairs H are not stacked more than ~200 μm away from the rod.

Figure 3:
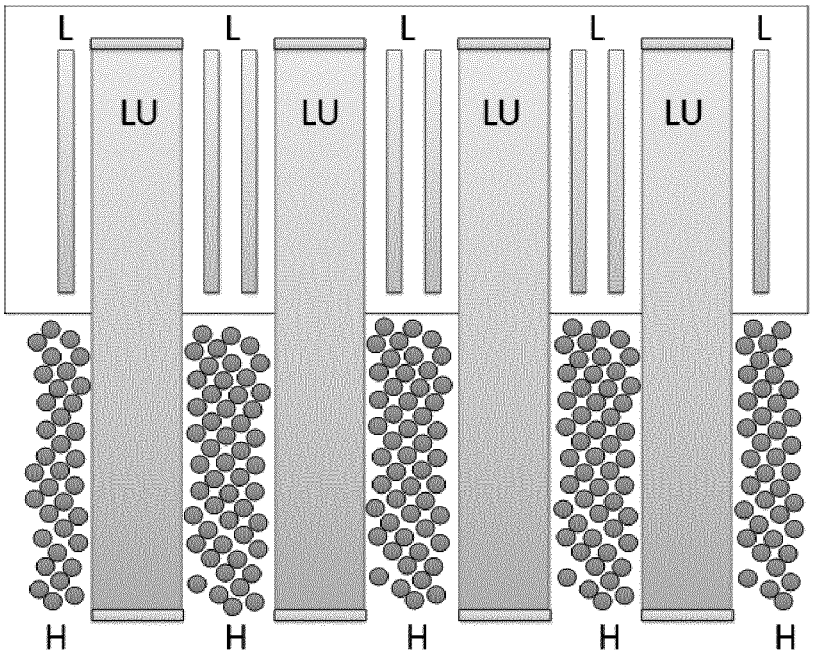
Figure 4:
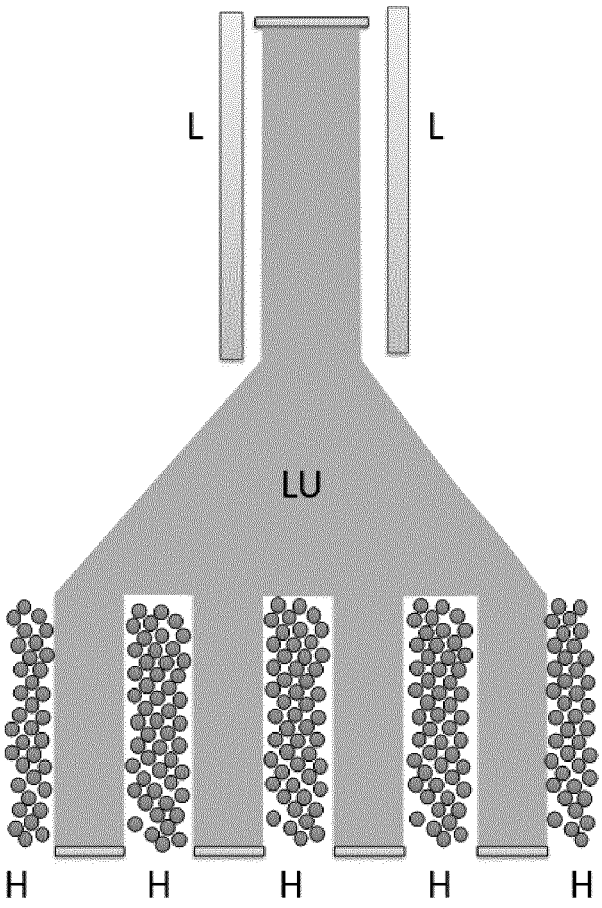

In other embodiments, the luminescent unit LU forms a comb-like structure. This can be done by using an array of multiple luminescent rods (FIG. 3), or by having a first location where the light is emitted into the luminescent rod, with the luminescent rod separating into several sub-branches (FIG. 4). Preferably, treatment compartments resulting from the sub-branches of the luminescent unit LU are dimensioned in such a manner, that they allow stacks of between 5 and 15, such as ~10 hair layers. In FIGS. 3 and 4, hair H is shown in the various treatment compartments.

In some embodiments, the hair bundles can be placed opposite to the light source. Such embodiments have the advantage of using both the converted light and the direct light from the light source to heat up the hairs, reducing loss of light.

In other embodiments, the loss of energy during the light conversion is used to heat the whole luminescent rod in order to provide two type of heating to the hair (photothermal and diffusion), thus maximizing the efficiency of the device.

In yet other embodiments, the surface emitting towards the hair can be coated with a scattering element in order to force the light to escape from the rod without having a contact with the hair. The scattering element may be a material (e.g. Teflon) or microstructures.

In some embodiments, the light-transmitting body is preferably a ceramic, but can also be a glass, a crystal or a polymer. The transmission of the light within the light-transmitting body without the dopant would preferably be close to 100% for the light emitted by the LED and the light converted by the dopant.

In some embodiments, the luminescent material may be a fluorescent or phosphorescent material or quantum dots. Typical fluorophores are listed in the article Losses in luminescent solar concentrators unveiled, by C. Tummelshammer, A. Taylor, A. J. Kenyon, I. Papakonstantinou, in: Solar Energy Materials and Solar Cells, Volume 144, January 2016, Pages 40-47. More preferably, ceramic doped with luminescent material (ceramic garnet) would be the most suitable material. They would typically be in the form $A_3B_5O_{12}$:Cr, where A is especially gadolinium (Gd) and yttrium (Y), B is especially aluminum (Al) or gallium (Ga). Additionally, a sensitizer such as $Ce^{3+}$ can be added to improve absorption of light. A typical material would be for example $Gd_3Ga_5O_{12}$:Cr. The $\eta_{PLQY}$ of this material is typically above 80% and the photoluminescence decay<300 μs.

Quantum dots can be used as well. Quantum dots are small crystals of semiconducting material generally having a width or diameter of only a few nanometers. When excited by incident light, a quantum dot emits light of a color determined by the size and material of the crystal. Most known quantum dots with emission in the visible range are based on cadmium selenide (CdSe) with a shell such as cadmium sulfide (CdS) and zinc sulfide (ZnS). Cadmium free quantum dots such as indium phosphode (InP), and copper indium sulfide ($CuInS_2$) and/or silver indium sulfide ($AgInS_2$) can also be used. Furthermore, the emission color can easily be tuned by adapting the size of the quantum dots.

Organic phosphors can be used as well. Examples of suitable organic phosphor materials are organic luminescent materials based on perylene derivatives, for example compounds sold under the name Lumogen® by BASF. Examples of suitable compounds include, but are not limited to, Lumogen® Red F305, Lumogen® Orange F240, Lumogen® Yellow F083, and Lumogen® F170.

Preferably, the concentration of luminescent sites in the converter material is high enough to have more than 99% conversion. That implies that the absorption length for the incident (LED) light should be less than 0.22 times the plate thickness.

In some embodiments, two of more types of luminescent material can be used to obtain a broader spectral range.

In the case where the LEDs are emitting UV light, an additional filter can be placed at the exit face for safety reason. In a filter-less configuration, the LEDs are placed sufficiently away from the exit face such that the UV light propagating within the light-transmitting body has close to 100% conversion.

For a straightener application, the hair styling device would just be a kind of optical comb in which heating and reshaping is done in the treatment compartments. For a curler application, the treatment compartments could be curved, e.g. provided around a rod having LEDs inside. A rod having LEDs inside but without treatment compartments has been mentioned in the earlier application PCT/EP2018/073508, incorporated herein by reference.

In an embodiment, luminescent units LU having respective specific shapes for hair curling and straightening applications may be interchangeable. The main unit or handle would comprise only the light source L, the luminescent unit LU would be an add-on. Different add-ons may have different diameters.

In an embodiment, pulsed LEDs are used to style hair. The output wavelength is preferably in the range between 400 and 900 nm, and more preferably in the range between 450 and 550 nm. The pulse width is preferably shorter than or equal to 200 ms, and more 10 preferably shorter than or equal to 100 ms. To prevent the hair from being damaged, the output energy fluence on the hair surface is preferably in the range between 1 J/cm$^2$ and 10 J/cm$^2$, more preferably between 3 J/cm$^2$ and 7 J/cm$^2$, and most preferably between 4 and 6 J/cm$^2$.

In an embodiment, not only optical energy but also heat from the LEDs (e.g. heat from the LEDs' heat sinks, or heat derived from optical energy outside a wavelength band suitable for hair styling) is used to heat a contact surface that contacts the hair, so that less optical energy from the LEDs in a suitable wavelength band is needed to heat the hair to a temperature above its glass transition temperature needed for hair styling, as described in more detail in the earlier application PCT/EP2018/073508.

The optical radiation source (e.g. one or more LEDs) may be arranged for radiating hairs using one radiation flash having a duration of at least 0.1 s. Alternatively, the optical radiation source may be arranged for radiating hairs using at least two radiation flashes, an interval between subsequent flashes being smaller than 5 s, preferably smaller than 1 s, and more preferably smaller than 0.3 s.

It should be noted that the above-mentioned embodiments illustrate rather than limit the invention, and that those skilled in the art will be able to design many alternative embodiments without departing from the scope of the appended claims. In one embodiment, the light source is turned on and off (flash) to form a pulsed wave (PW) to vary the light output so that hair can receive required optical energy to increase temperature required for styling. Alternatively, the light source is turned on (not off) to form a continuous wave (CW), in combination with a suitable light source control to ensure that hairs are not overexposed to light energy by regulating the current flowing through the LEDs during operation to limit the light output. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention may be implemented by means of hardware comprising several distinct elements, and/or by means of a suitably programmed processor. In the device claim enumerating several means, several of these means may be embodied by one and the same item of hardware. The mere fact that certain measures are recited in mutually different dependent claims that do not refer to one another does not indicate that a combination of these measures cannot be used to advantage.

The invention claimed is:

1. A hair styling device configured for curling and/or straightening of hair, the hair styling device comprising:

a light source configured to emit light, wherein the light source comprises a light emitting diode (LED) or an organic light emitting diode (OLED); and a luminescent unit configured to receive the light emitted by the light source, wherein the luminescent unit comprises a luminescent material configured to translate the received light to converted light in response to the received light exciting the luminescent material, and to emit a part of the converted light from the luminescent unit for subjecting the hair to optical radiation.

2. The hair styling device as claimed in claim 1, wherein the luminescent material is configured to translate the received light from a first wavelength of the light emitted from the light source into a second wavelength of the converted light.

3. The hair styling device as claimed in claim 1, wherein the luminescent unit is arranged to hamper the converted light from escaping from the luminescent unit, except where hair contacts the luminescent unit.

4. The hair styling device as claimed in claim 1, wherein a surface of the luminescent unit is coated with a scattering element, forcing the light to escape from the luminescent unit without having contact with the hair.

5. The hair styling device as claimed in claim 1, wherein a refractive index of the luminescent unit ranges from 1.3 to 1.7.

6. The hair styling device as claimed in claim 1, wherein the luminescent unit defines a plurality of treatment compartments.

7. The hair styling device as claimed in claim 1, further comprising a handle, wherein the light source is insertable into the handle for coupling the light into the luminescent unit.

8. The hair styling device as claimed in claim 7, wherein the luminescent unit is exchangeable with a plurality of other luminescent units insertable into the handle, and wherein each of the plurality of other luminescent units is adapted for a respective hair styling type.

9. The hair styling device as claimed in claim 1, wherein a refractive index of the luminescent unit ranges from 1.3 to 1.42.

10. The hair styling device as claimed in claim 1, wherein the luminescent unit forms a waveguide configured to trap another part the converted light due to total internal reflection (TIR), and wherein the part of the converted light is emitted from the luminescent unit as escaping light when the hair touches a surface of the luminescent unit.

11. The hair styling device as claimed in claim 10, wherein the luminescent unit further comprises a plurality of mirrors positioned on opposite ends to internally reflect the converted light within the waveguide.

12. The hair styling device as claimed in claim 1, wherein the luminescent material comprises a fluorescent material or a phosphorescent material.

13. The hair styling device as claimed in claim 1, wherein the luminescent material comprises quantum dots.

14. The hair styling device as claimed in claim 1, wherein the luminescent unit comprises a single luminescent rod containing the luminescent material.

15. The hair styling device as claimed in claim 1, wherein the luminescent unit comprises a plurality of luminescent rods forming a comb-like structure, wherein each of the plurality of luminescent rods contains a portion of the luminescent material.

16. The hair styling device as claimed in claim 1, wherein the luminescent unit comprises a first luminescent rod portion, through which the light is emitted into the luminescent unit from the light source, and a second luminescent rod portion comprising a plurality of sub-branches to form a comb-like structure, wherein each of the first and second luminescent rod portions contains a portion of the luminescent material.

17. The hair styling device as claimed in claim 1, wherein luminescent unit comprises a light-transmitting body formed of a ceramic, a glass, a crystal or a polymer.

18. A hair styling device configured for curling and/or straightening of hair, the hair styling device comprising:

a light source configured to emit light having a first wavelength; and a luminescent unit configured to receive the light emitted by the light source, wherein the luminescent unit comprises a luminescent material configured to translate the received light to converted light, having a second wavelength different from the first wavelength, in response to the received light exciting the luminescent material, and wherein the luminescent unit is further configured to emit the converted light as escaping light from a surface of the luminescent unit at locations where the hair contacts the surface.

19. The hair styling device as claimed in claim 18, wherein the luminescent unit further comprises a plurality of mirrors positioned on opposite ends of the luminescent unit to internally reflect the converted light.

20. The hair styling device as claimed in claim 18, wherein the luminescent unit comprises a plurality of luminescent rods forming a comb-like structure, wherein each of the plurality of luminescent rods contains a portion of the luminescent material.

* * * * *